US005461997A

United States Patent [19]

Landén

[11] Patent Number: 5,461,997

[45] Date of Patent: Oct. 31, 1995

[54] SEWING MACHINE HAVING PRESSER FOOT LIFTING DEVICE FOR ADJUSTING A PRESSER FOOT BETWEEN FIRST, SECOND, AND THIRD POSITIONS

[75] Inventor: Jan-Olof Landén, Huskvarna, Sweden

[73] Assignee: Husqvarna Aktiebolag, Huskvarna, Sweden

[21] Appl. No.: 227,669

[22] Filed: Apr. 14, 1994

[30] Foreign Application Priority Data

Apr. 21, 1993 [SE] Sweden ..... 9301319

[51] Int. Cl.[6] ..... D05B 29/02

[52] U.S. Cl. ..... 112/237

[58] Field of Search ..... 112/237, 239, 112/121.11, 235, 275, 277

[56] References Cited

U.S. PATENT DOCUMENTS

| | | | |
|---|---|---|---|
| 3,473,497 | 10/1969 | Cash . | |
| 4,363,281 | 12/1982 | Reinke . | |
| 4,706,587 | 11/1987 | Shiomi | 112/237 |
| 5,080,031 | 1/1992 | Suzuki et al. | 112/237 X |
| 5,144,900 | 9/1992 | Takahashi | 112/239 X |
| 5,331,909 | 7/1994 | Tajima et al. | 112/239 |

FOREIGN PATENT DOCUMENTS

| | | | |
|---|---|---|---|
| 3637601 | 11/1990 | Germany . | |
| 0049185 | 1/1992 | Japan | 112/237 |

*Primary Examiner*—Peter Nerbun

*Attorney, Agent, or Firm*—Pearne, Gordon, McCoy & Granger

[57] ABSTRACT

A sewing machine of the type having an electronic control unit is provided with an arrangement comprising a needle mechanism with a needle bar, a presser bar (12) provided with a presser foot (13) and actuated by a resilient means (22) to provide a controllable presser foot pressure on the cloth (28) to be sewn, and a lifting device for adjusting the presser foot between its operative position and an inoperative position spaced from the cloth. According to the invention, the lifting device comprises a power driven lifting lever (15) coacting with the presser bar (12) for adjusting the presser foot (13) between said two positions and a third, operative position, in which the presser foot pressure is relieved, and the lifting lever (15) is operatively connected to said resilient means (22) for controlling the presser foot pressure.

9 Claims, 7 Drawing Sheets

SEWING MACHINE HAVING PRESSER FOOT LIFTING DEVICE FOR ADJUSTING A PRESSER FOOT BETWEEN FIRST, SECOND, AND THIRD POSITIONS

BACKGROUND OF THE INVENTION

The present invention relates to an arrangement in a sewing machine of the type which is provided with an electronic control unit, the arrangement comprising a needle mechanism having a needle bar, a presser bar provided with a presser foot and actuated by a resilient means in order to provide a controllable presser foot pressure against the cloth to be sewn, and a lifting device for adjusting the presser foot between an operative position and an inoperative position spaced from the cloth.

According to the invention, in a sewing machine of the above-mentioned kind extended and improved sewing functions have been obtained. An object of the arrangement according to the invention is to provide power-driven elevation of the presser foot to an inoperative position when the actual seam is completed. Another object is to provide an intermittent, limited elevation of the presser foot during the sewing procedure, the cloth being held during stretching of the sewing-thread and released when the needle is at its top position in order to enable manual cloth feed. Another object is to provide an intermittent, limited elevation of the presser foot when the needle is at its bottom position and engaging the cloth, to enable lateral cloth feed by means of the needle. Another object is to enable control of the presser foot pressure to a preferred value irrespective of the thickness of the cloth. A further object is to enable sensing of the cloth thickness and to adjust the sewing-thread tension in relation to the sensed value.

SUMMARY OF THE INVENTION

The above-mentioned objects have been obtained by means of an arrangement of the kind mentioned in the introduction which according to the invention is characterized in that the lifting device comprises a power-driven lifting lever cooperating with the presser bar to adjust the presser foot between said positions and a third, operative position in which the presser foot pressure is relieved, said lifting lever being operatively connected to said resilient means for controlling the presser foot pressure.

BRIEF DESCRIPTION OF THE DRAWINGS

The invention will be described in more detail in the following with reference to the accompanying drawings, in which.

DETAILED DESCRIPTION OF PREFERRED EMBODIMENTS

Figure 1:
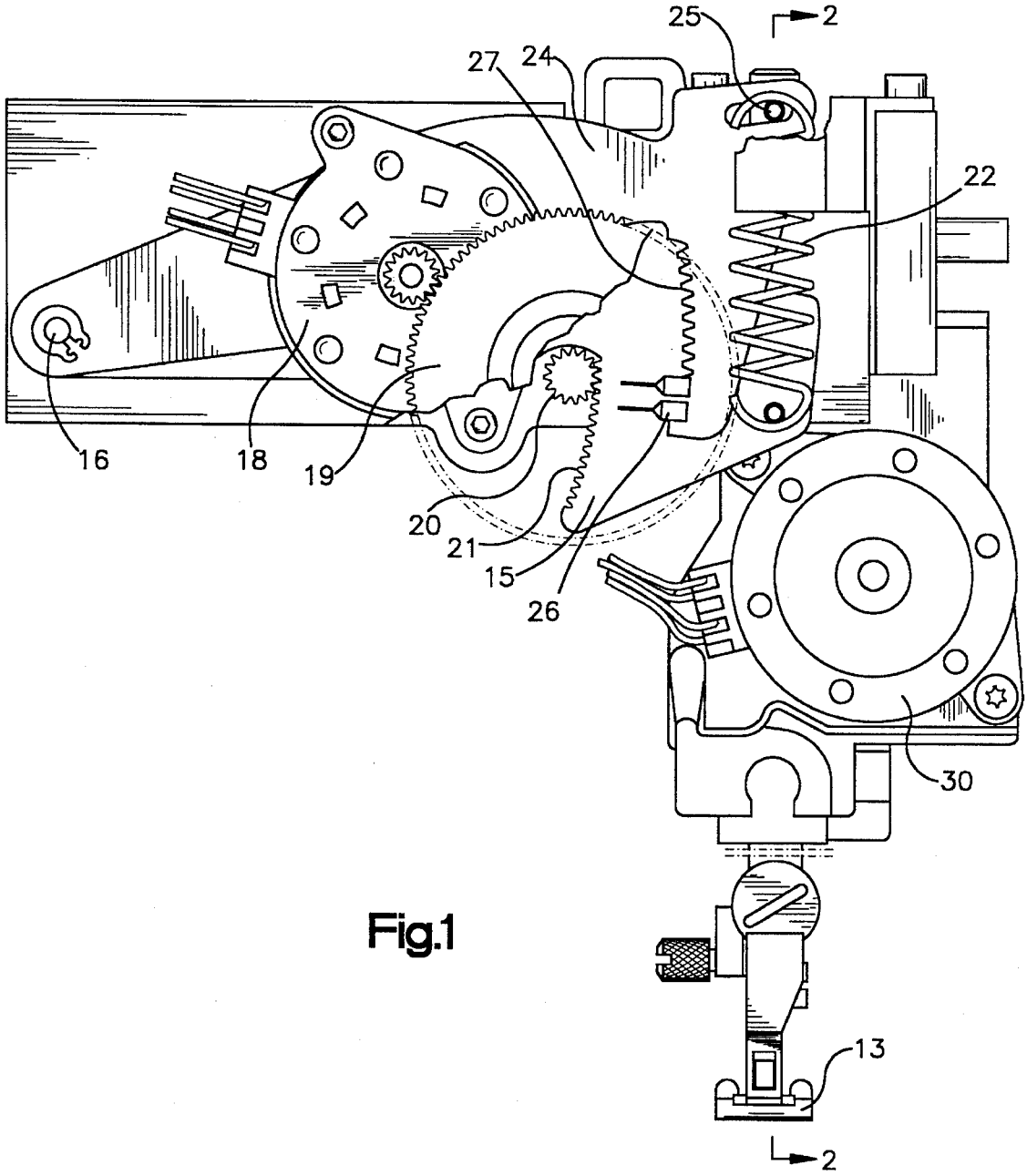
FIG. 1 is a view of the arrangement according to the invention as seen from the back of the sewing machine.
Figure 2:
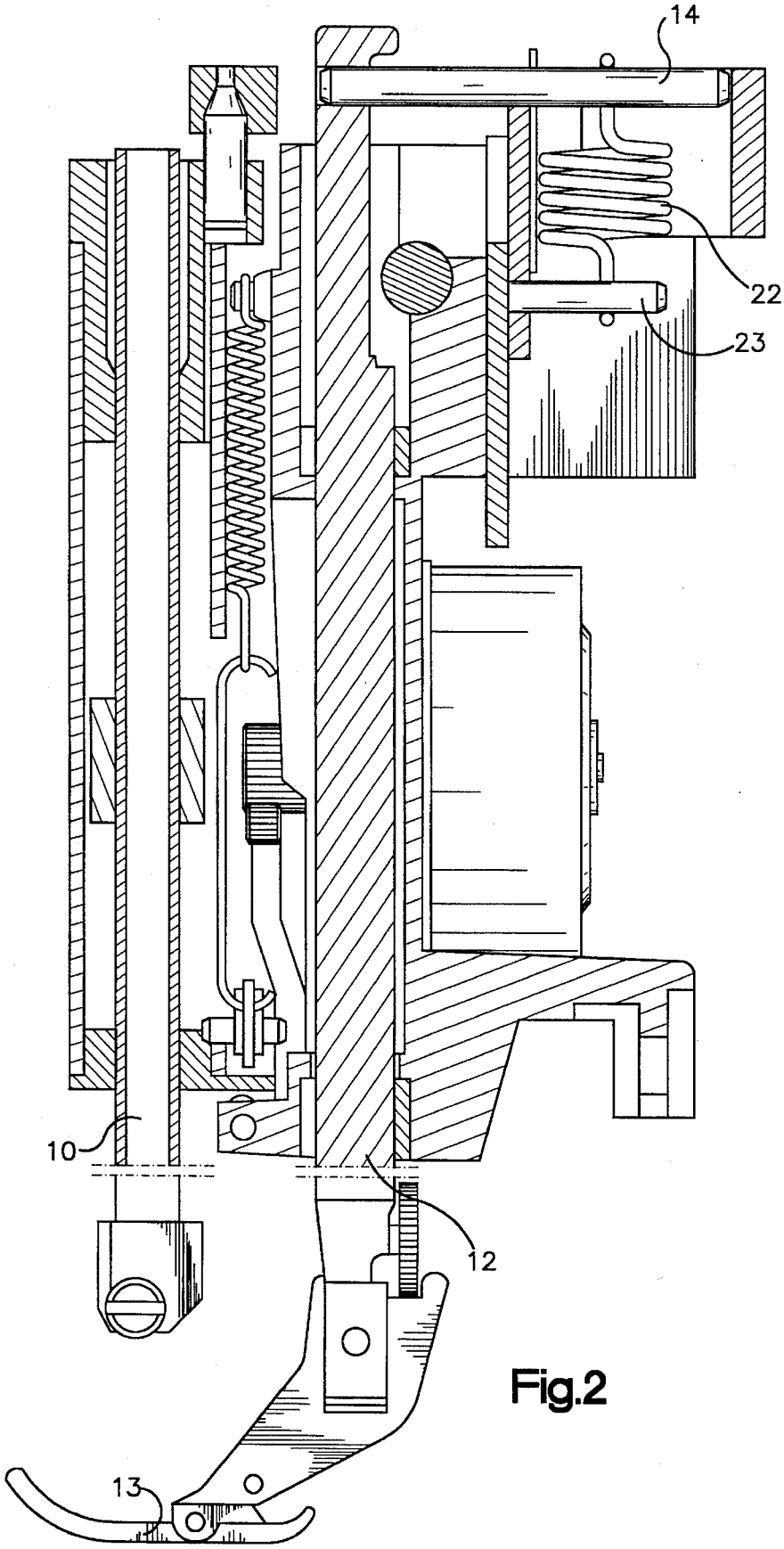
FIG. 2 is a section along line II—II of the arrangement shown in FIG. 1.

The arrangement shown in the drawings, which is intended to constitute a portion of a domestic sewing machine, comprises a vertically movable needle bar 10 provided with a needle 11 and a likewise vertically movable presser bar 12 provided with a presser foot 13. The presser bar is provided with a horizontal pin 14 at the top end thereof.

The vertical movement of the presser bar is provided by means of a lifting lever 15 which is rotatably journalled on a shaft 16 and provided with an abutment 17 cooperating with the pin 14. The lifting lever is powered by a stepping motor 18 via a reduction gear 19 having a pinion 20 meshing with a gear segment 21 of the lifting lever. In order to obtain an appropriate, resilient presser foot pressure a tension spring 22 is provided which extends between the pin 14 of the presser bar and a horizontal pin 23 provided on the lifting lever 15. The presser foot pressure can thereby be controlled by means of the lifting lever, as will be described in more detail in the following.

In order to determine the position of the presser bar and the presser foot, the arrangement comprises a code disc 24, one end of which is rotatably journalled on the shaft 16 and the other end of which is movably connected to the presser bar by means of an elongated opening 25 through which the pin 14 extends with a close fit. By means of a differential gauge comprising optical position sensors 26 attached to the lifting lever 15 and cooperating with a toothed segment 27 of the code disc the mutual positions of the lifting lever and the code disc are determined. When the presser foot is in its elevated position and thus not engaging the cloth below, no mutual movement of the lifting lever and the code disc takes place. When the presser foot is lowered and engages the cloth, whereby its descending movement is stopped, the continuing downward movement of the lifting lever 15 will result in tensioning the spring 22 and a corresponding increase of presser foot pressure. With a knowledge of the spring constant, the position difference sensed by the sensor 26 provides a indication of the presser foot pressure. A suitable presser foot pressure is set by the control unit of the machine with regard to input values of cloth material, seam selection, etc.

Figure 5:
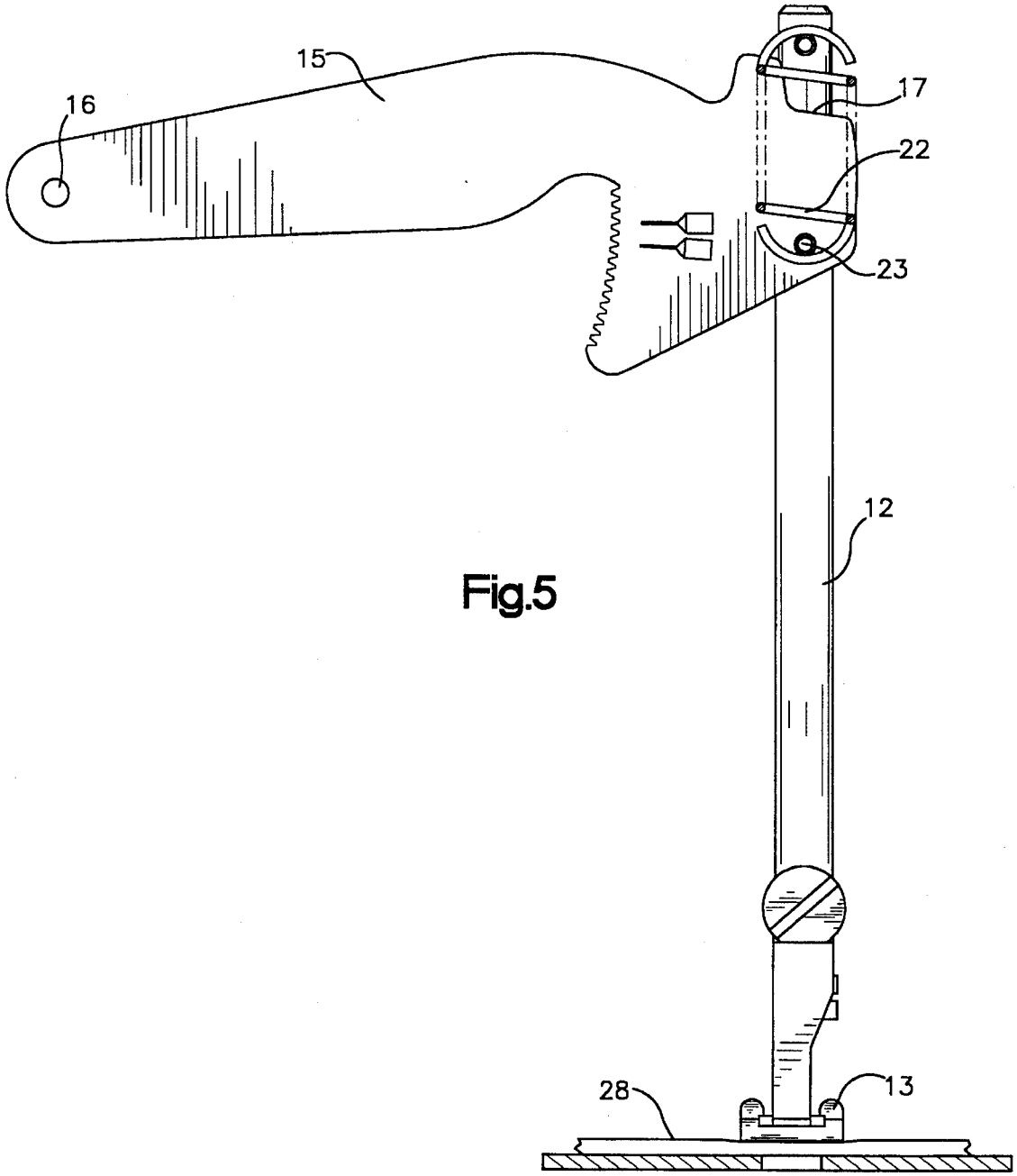
FIGS. 5–7 are partial side views of the arrangement in different positions.

During normal sewing (FIGS. 3 and 5) the cloth is held between the presser foot 13 and a supporting needle plate 29. When the thickness of the cloth varies, for example due to a varying number of cloth layers, the presser bar will be displaced, which in a conventional sewing machine will lead to a variation of the presser foot pressure due to actuation of the spring tension. Such variation of the presser foot pressure in relation to the cloth thickness is in most cases disadvantageous to the sewing result. The arrangement according to the invention offers the possibility to avoid this drawback in that the movement of the presser bar is sensed by the differential gauge 26, 27, and by keeping the sensed value constant it is possible, if preferred, to provide a constant presser foot pressure irrespective of variations of the cloth thickness. This is obtained in that the position of the lifting lever 15 is adjusted by means of the motor 18 a distance corresponding to the displacement of the presser bar, whereby the tension of the spring 22 is maintained unchanged. It is also possible to obtain any desired relation between the presser foot pressure and the cloth thickness that might be appropriate for the actual sewing operation. In such case, the preferred relation between the presser foot pressure and the cloth thickness is set by means of the control unit of the sewing machine.

Figure 6:
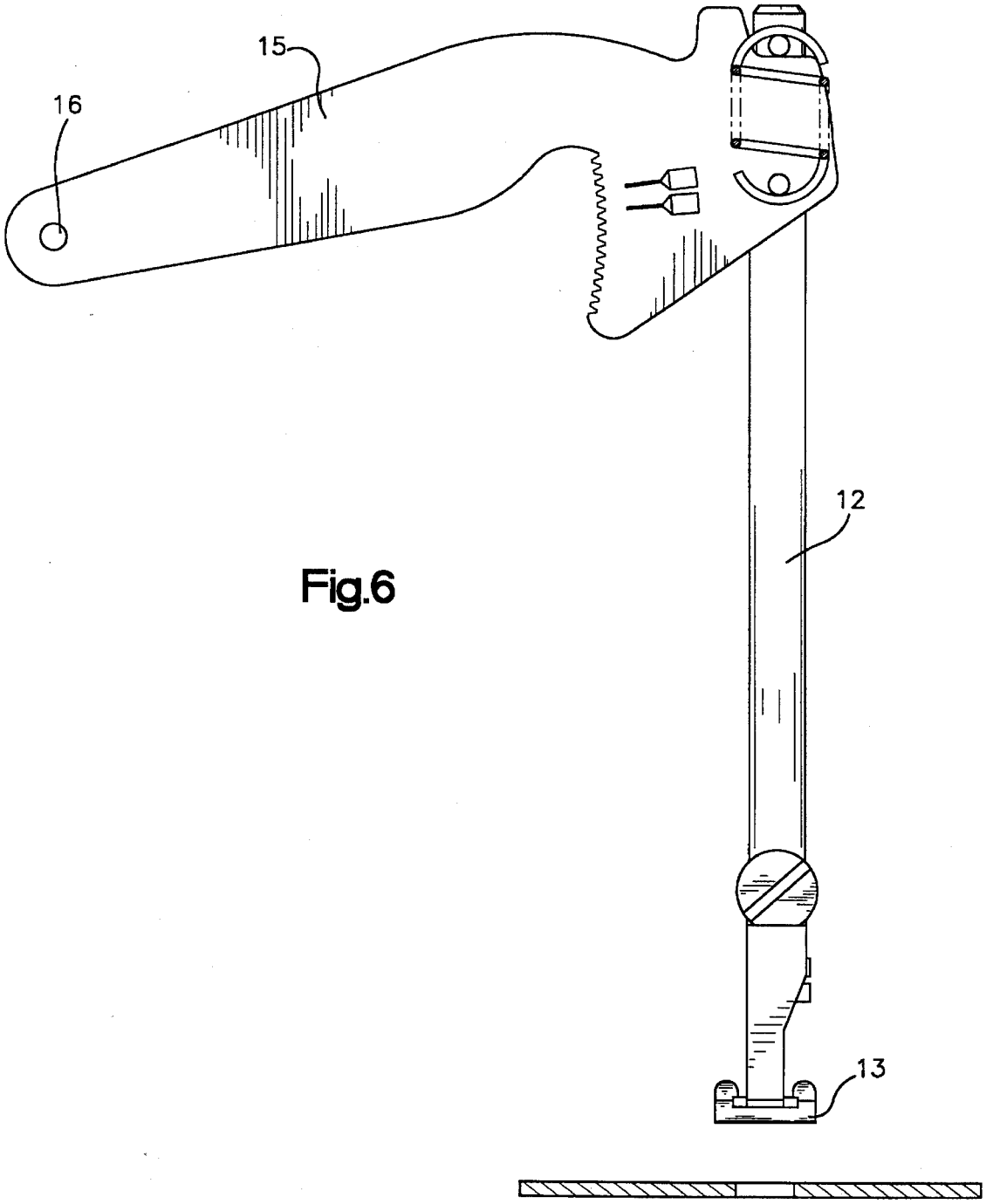

When the presser foot is to be adjusted to the elevated position shown in FIG. 6, the motor 18 is actuated to assume an angular position pre-programmed in the control unit, whereby the abutment 17 of the lifting lever engages the pin 14 of the presser bar and the presser foot is raised to a predetermined position. In addition to a normal elevated position, the machine preferably has a second elevated position in which the presser foot is raised a further distance to enable inserting extra thich cloth under the same. This extra elevation is preferably activated by keeping the control button for raising the presser foot on the control panel (not shown) of the machine depressed for a suitable, predetermined time.

Figure 7:
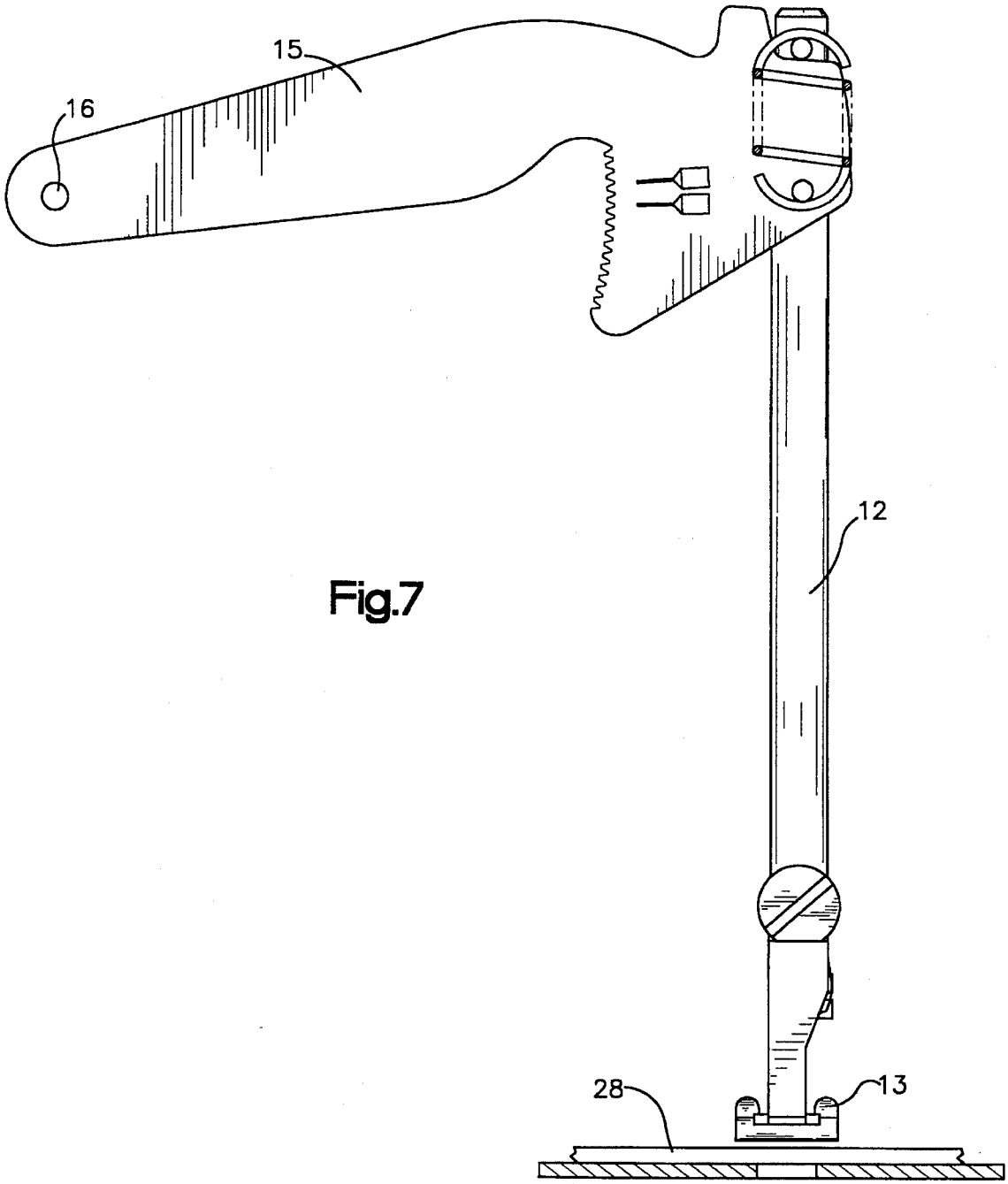

In FIG. 7, the presser foot 13 is shown in a position in which it is raised just enough to relieve the presser foot pressure whereby the cloth is not held in a fixed position but can be moved. To provide adjustment to this position the stepping motor is activated for lifting until the movement sensed by the differential gauge 26, 27 has ceased, and then an additional predetermined number of steps, to release the cloth. This position can be used optionally in two different ways during the sewing operation.

In a first sewing program utilizing this pressure relief the machine is programmed to release the cloth temporarily during a short period when the needle is in its top position in which a cloth feed is normally carried out by means of the feed dog of the machine. Due to the fact that the cloth is not fixed in this stage, a manual cloth feed can be made instead of the automatic cloth feed which is then preferably made inoperative. By the end of the mentioned period the presser foot returns to its lowered position and normal presser foot pressure, whereby the cloth is held during stitch formation and thread tensioning. This sewing program thus permits manual cloth feed in any desired direction and can preferably be used in for example basting or darning.

Figure 3:
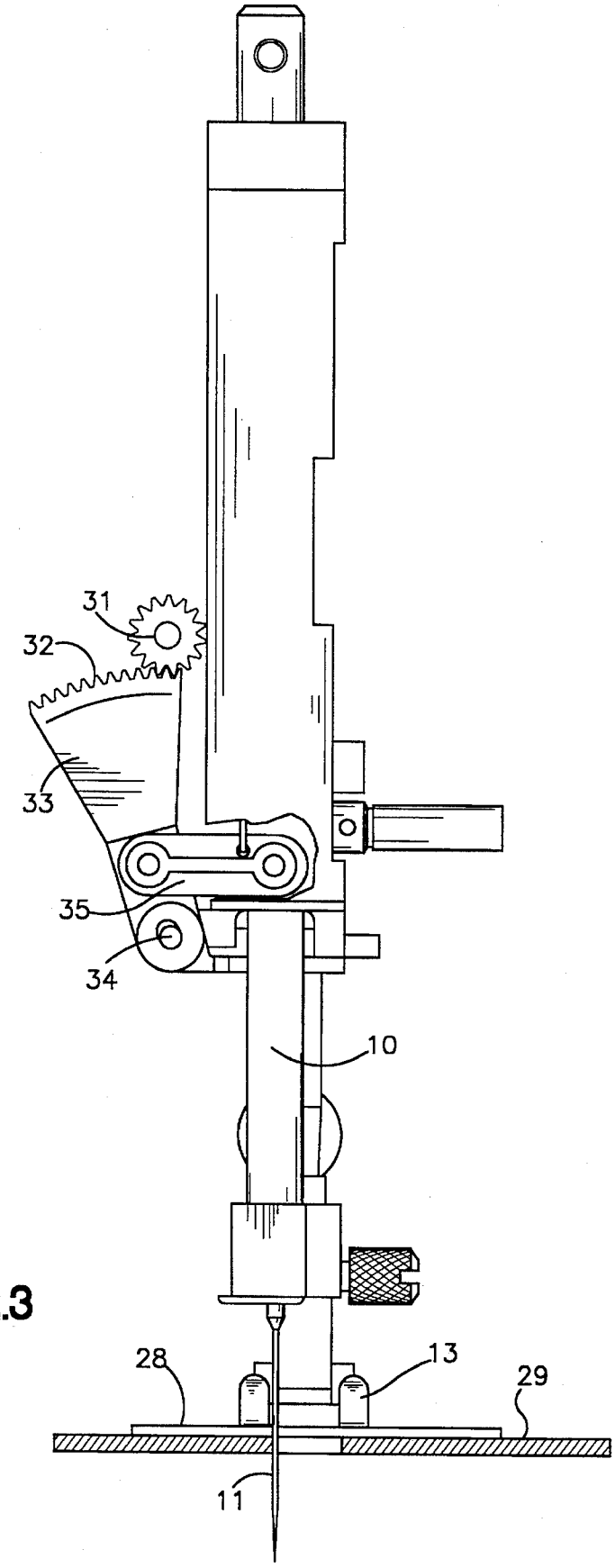
FIG. 3 is a partial end view of the arrangement shown in FIG. 1.
Figure 4:
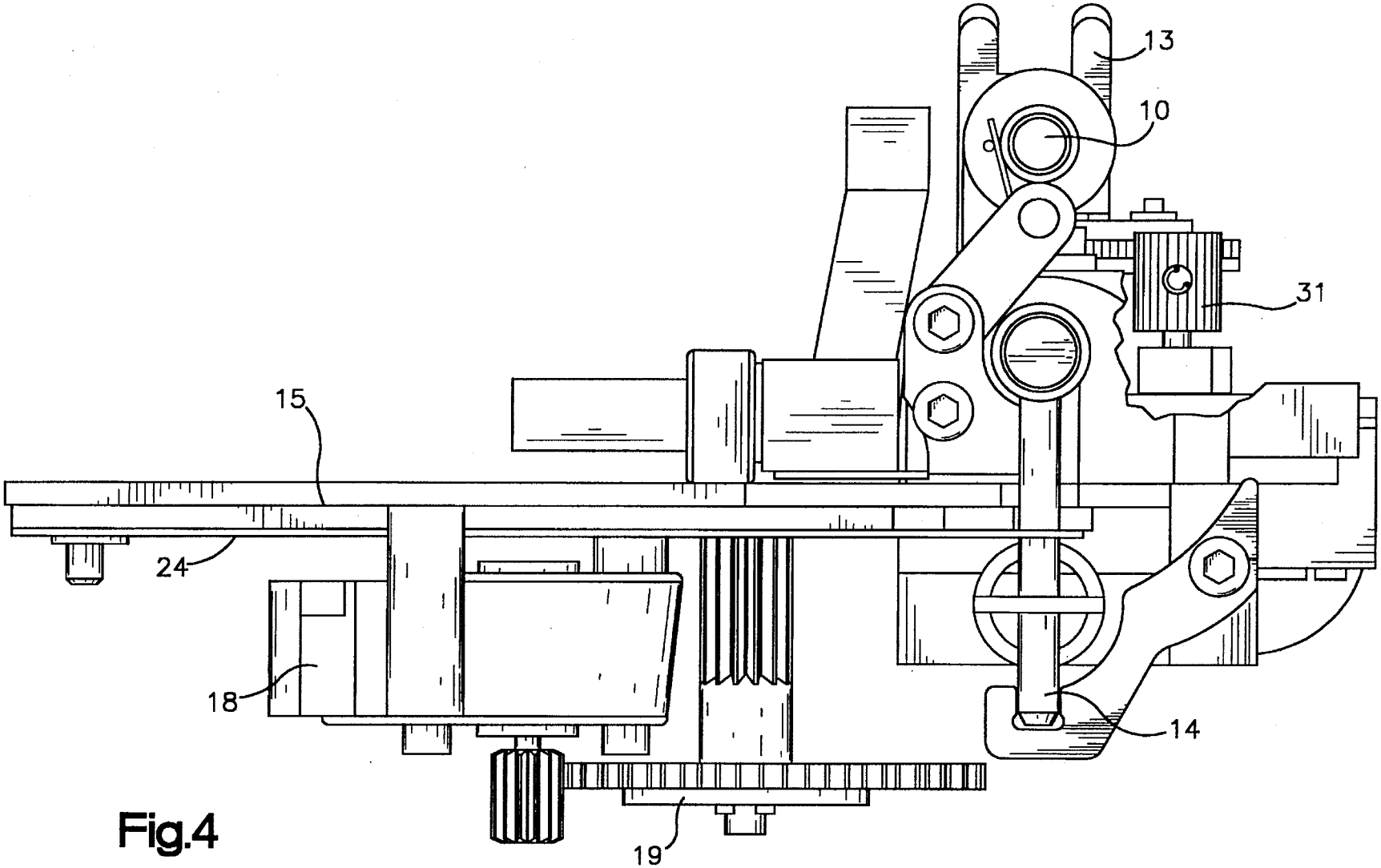
FIG. 4 is a top plan view of the same arrangement.

In a second sewing program, the cloth is temporarily released for a short period when the needle is in its lower position and thus engages the cloth (FIG. 3). In this case, lateral cloth feed is provided by the zigzag mechanism of the machine. In the illustrated embodiment, this mechanism comprises a stepping motor 30 provided with a pinion 31 engaging a toothed segment 32 provided on a lever 33 which is rotatably journalled on a shaft 34. The lever 33 is connected via a link 35 to the bearing of the needle bar 10 whereby the needle can be displaced laterally a distance which can be selected by the zigzag control of the machine. As is known, such lateral displacement of the needle normally takes place at the top position of the needle to provide zigzag stitching. In the sewing machine according to the invention, the cloth is released at the lower position of the needle and the cloth is then displaced laterally by means of the zigzag mechanism and the needle 11. The presser foot is then lowered again and a normal presser foot pressure is applied.

By utilizing this sewing function it is possible to provide a seam extending cross-wise of the normal sewing direction of the machine. In addition, by combining this lateral cloth feed with normal forward or backward cloth feed at the top position of the needle and selecting a preferred stroke for both said mutually perpendicular cloth feeds, it is possible to produce a seam extending in any preferred direction. It should be easily realized that this provides new and generally unlimited possibilities of producing utility as well as fancy seams. It is an advantage in comparison with lateral feed by the normal cloth feed dog, as is provided in certain types of sewing machines, that much longer lateral feed strokes can be obtained, by utilizing the entire zigzag width for the lateral cloth feed.

A further advantageous feature of the described arrangement is that it provides the possibility of continuous control of the cloth thickness during the sewing procedure. For determining the cloth thickness, the position of the presser foot is calculated which is obtained with the aid of the angular position of the stepping motor 18 and the value sensed by the differencial gauge 26. The actual presser foot position is compared with a reference position in which the presser foot engages the needle plate without any intermediate cloth. The reference position is stored in the memory of the control unit in the form of an angular position of the motor 18. The sensing of the cloth thickness is used for adjusting the tension of the sewing thread. This is carried out in such way that the previously set thread tension, which is selected with regard to cloth material and type of seam, is continuously fineadjusted in relation to the actual cloth thickness by utilizing the sensed value for controlling a servo motor (not shown) which actuates the thread tensioning device of the sewing machine. The adjustment is made such that the thread tension increases with the cloth thickness. As the thread tension is constantly adjusted to the actual cloth thickness, it is possible to obtain a seam of high and even quality irrespective of the variations of the cloth thickness.

I claim:

1. An arrangement in a sewing machine of the type which is provided with an electronic control unit, said arrangement comprising a needle mechanism having a needle bar (10), a presser bar (12) provided with a presser foot (13) and actuated by a resilient means (22) in order to provide a controllable presser foot pressure against a cloth (28) to be sewn, and a lifting device for adjusting the presser foot between a first operative position in which the presser foot pressure is applied to hold the cloth, a second inoperative position spaced from the cloth, and a third operative position in which the presser foot pressure is removed to release the cloth, wherein said lifting device comprises a power-driven lifting lever (15) cooperating with the presser bar (12) to adjust the presser foot (13) between said first, second, and third positions, said lifting lever (15) being operatively connected to said resilient means (22) for controlling the presser foot pressure.

2. Arrangement according to claim 1, further comprising a position sensing means adapted to sense mutual positions of the presser bar (12) and the lifting lever (15) in order to control the presser foot pressure with aid thereof.

3. Arrangement according to claim 2, wherein said position sensing means comprises a differential gauge (26, 27) which senses a position of the lifting lever (15) in relation to a means (24) connected to the presser bar (12).

4. Arrangement according to any of claims 1–3, wherein said lifting lever (15) is adapted to actuate the presser foot (13) between said first and third operative positions to alternatingly hold and release the cloth (28) during a sewing operation.

5. Arrangement according to claim 4, wherein said lifting lever (15) is adapted to actuate the presser foot (13) to said third operative position to release the cloth temporarily when the needle (11) is at the top of its course of movement and released from the cloth, in order to enable manual displacement thereof.

6. Arrangement according to claim 4, wherein said lifting lever (15) is adapted to actuate the pressure foot (13) to said third operative position to release the cloth temporarily when the needle (11) is at the bottom of its course of movement and engaging the cloth, in order to enable displacement thereof by means of the needle.

7. Arrangement according to any of claim 3, wherein said differential gauge (26, 27) is adapted for continuously sensing the cloth thickness during a sewing procedure by comparing the position of the presser bar (12) with a reference position in which the presser foot engages a needle plate (29) without intermediate cloth, the position of the presser bar being determined in relation to the position of the lifting lever (15).

8. Arrangement according to claim 7, wherein said lifting lever is actuated by a stepping motor (18), the position of the presser bar being determined by comparing an actual angular position of said stepping motor with an angular position in the reference position.

9. Arrangement according to claim 7, further comprising control means for controlling tension of sewing thread in relation to the sensed cloth thickness.

* * * * *

UNITED STATES PATENT AND TRADEMARK OFFICE

CERTIFICATE OF CORRECTION

PATENT NO. : 5,461,997

DATED : October 31, 1995

INVENTOR(S) : Jan-Olof Landen

It is certified that error appears in the above-identified patent and that said Letters Patent is hereby corrected as shown below:

Column 4, line 64, (Claim 7, line 1), delete "any of".

Signed and Sealed this

Twenty-first Day of May, 1996

Bruce Lehman

*Attest:*

BRUCE LEHMAN

*Attesting Officer*

*Commissioner of Patents and Trademarks*